US007331276B2

(12) United States Patent
Schleβmann et al.

(10) Patent No.: US 7,331,276 B2
(45) Date of Patent: Feb. 19, 2008

(54) PISTON FOR A TWO-CYCLE ENGINE

(75) Inventors: Helmut Schleβmann, Prüm (DE); Tobias Wurster, Esslingen (DE); Andreas Bähner, Weinstadt (DE); Ralf-Rainer Kemmler, Schwaikheim (DE)

(73) Assignee: Andreas Stihl AG & Co. KG (DE)

( * ) Notice: Subject to any disclaimer, the term of this patent is extended or adjusted under 35 U.S.C. 154(b) by 57 days.

(21) Appl. No.: 11/336,526

(22) Filed: Jan. 20, 2006

(65) Prior Publication Data

US 2006/0162550 A1 Jul. 27, 2006

(30) Foreign Application Priority Data

Jan. 22, 2005 (DE) ..... 10 2005 003 061

(51) Int. Cl.
*F16J 1/04* (2006.01)

(52) U.S. Cl. ..... 92/239; 92/208

(58) Field of Classification Search ..... 92/186, 92/208, 235, 239

See application file for complete search history.

(56) References Cited

U.S. PATENT DOCUMENTS

| | | | | |
|---|---|---|---|---|
| 4,730,549 | A * | 3/1988 | Pfeiffenberger | 92/239 |
| 4,987,866 | A * | 1/1991 | Mielke et al. | 92/235 |
| 5,630,391 | A | 5/1997 | Anderson et al. | |
| 6,318,243 | B1 * | 11/2001 | Jones | 92/208 |
| 2005/0045138 | A1 * | 3/2005 | Schmidt et al. | 123/184.46 |

* cited by examiner

*Primary Examiner*—Michael Leslie
(74) *Attorney, Agent, or Firm*—Robert W. Becker; Robert W. Becker & Associates

(57) ABSTRACT

A piston for a two-cycle engine having a piston head and a piston wall in which are disposed wrist pin eyes. At least one undercut is formed between the underside of the piston head and the wrist pin eyes at a distance from the piston head. The undercut extends from the interior of the piston toward the piston wall. A respective thickened portion is provided in at least one region of the piston that is rotationally shifted about the longitudinal axis of the piston by 90° relative to one of the wrist pin eyes. The thickened portion is disposed at a distance below the piston head and extends into the interior of the piston.

17 Claims, 3 Drawing Sheets

PISTON FOR A TWO-CYCLE ENGINE

BACKGROUND OF THE INVENTION

The present invention relates to a piston for a two-cycle engine, especially the mixture-lubricated two-cycle engine of a manually-guided implement such as a power saw, a cut-off machine, or the like.

U.S. Pat. No. 5,630,391 discloses a piston for an internal combustion engine in a motor vehicle, with a recess being disposed on the inner side of the piston that extends above the wrist pin bore and in which oil is intended to accumulate that is to be pressed onto the wrist pin boss.

It has been shown that no adequate cooling of the wrist pin eye of a mixture-lubricated two-cycle engine can be achieved with such a measure.

It is therefore an object of the present invention to provide a piston for a two-cycle engine with which a heating-up of the wrist pin eye is reduced.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
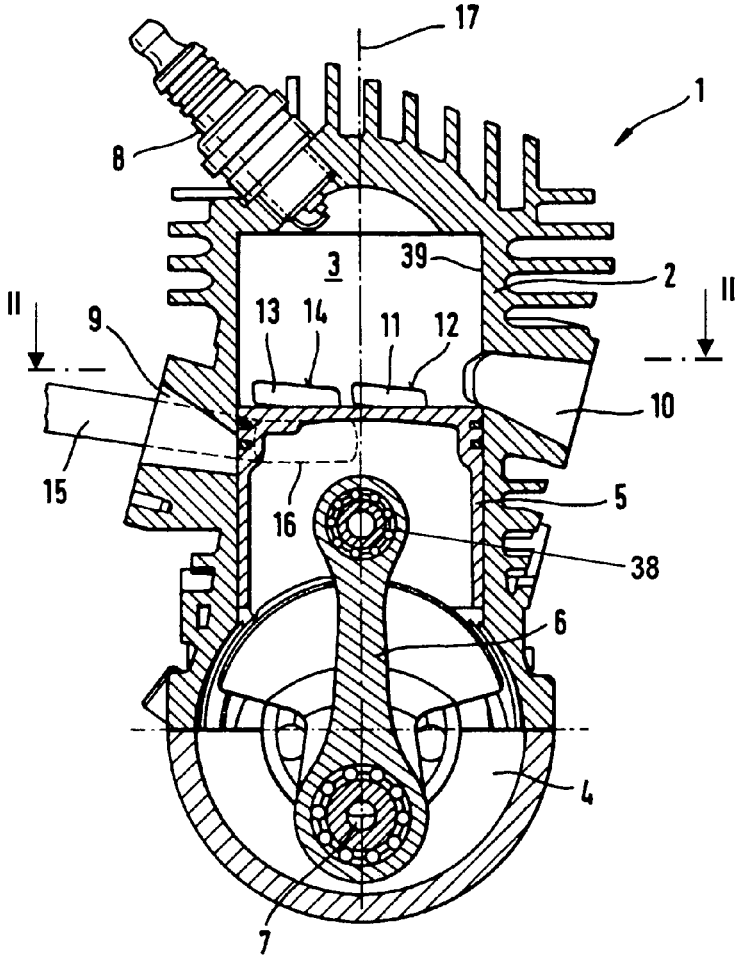
FIG. 1 is a longitudinal cross-sectional view through a two-cycle engine.

The piston of the present application comprises a piston head that delimits the combustion chamber of the two-cycle engine, whereby the underside of the piston head delimits the crankcase of the two-cycle engine. The piston also comprises a piston wall in which are disposed wrist pin eyes for supporting a wrist pin. At least one undercut is formed between the underside of the piston head and the wrist pin eye at a distance from the piston head, whereby the undercut extends from the interior of the piston in a direction toward the piston wall. The piston furthermore comprises a respective thickened portion in at least one region of the piston that is rotationally shifted about the longitudinal axis of the piston by 90° relative to one of the wrist pin eyes, whereby the thickened portion is disposed at a distance below the piston head and extends into the interior of the piston.

To reduce the transfer of heat from the piston head into the wrist pin eyes, an undercut is disposed between a wrist pin eye and the piston head. The depth of the undercut is advantageously such that the piston can be manufactured in a casting process. At the same time, however, it is necessary to ensure the strength of the piston. Since for these reasons the undercut cannot be produced with an arbitrary depth, it is provided that a thickened portion be disposed below the piston head in a region that is rotationally shifted about the longitudinal axis of the piston by 90° relative to the wrist pin eye. The thickened portion leads to an improved introduction of the heat from the piston head into the side walls of the piston that face the inlet and/or the outlet of a two-cycle engine and are disposed between the wrist pin eyes. A heating-up of the wrist pin eyes can be reduced by the combination of reducing the wall thickness above the wrist pin eyes and increasing the wall thickness in the region between the wrist pin eyes.

Two oppositely disposed undercuts are advantageously provided, with the thickened portion extending in a circumferential direction from one undercut to the opposite undercut. A good transfer of heat out of the piston head is ensured due to the fact that the thickened portion essentially extends over the entire periphery disposed between the undercuts. Two oppositely disposed thickened portions are expediently provided so that a uniform transfer of heat is achieved into those sections of the piston wall or skirt that are disposed between the wrist pin eyes. For a good transfer of heat, the wall thickness of the piston at the thickened portion, at the distance of the undercut from the piston head below the piston head, is at least 20%, and preferably more than 30%, of the radius of the piston. A thickened portion can be easily obtained if the inner wall of the piston extends from the piston skirt to the underside of the piston head with a radius that is at least 30% of the radius of the piston. A uniform transition is achieved in this way. To reduce the introduction of heat into the wrist pin eye, the wall thickness of the piston in the region of the undercut can be less than half of the radius of the piston.

An improvement of the heat transfer out of the piston head can be achieved by disposing at least one rib on the underside of the piston head. However, the rib can also extend transverse to the longitudinal axis of the wrist pin eye. In this case, at least one section of a thickened portion is formed by a rib. The rib leads to an increase of the surface of the underside of the piston head, thereby increasing the thermal radiation toward the crankcase. With a rib that extends transverse to the longitudinal axis of the wrist pin eye, the heat transfer transverse to the wrist pin eye, in other words into the region disposed between the wrist pin eyes, is at the same time increased. In this connection, the rib in particular merges into the thickened portion, thus ensuring a good transfer of heat. The height of the rib measured from the piston head is advantageously greater than the distance of the undercut from the piston head. This leads to a withdrawal of the heat from the middle of the piston head preferably in the direction of the rib, and less heat is withdrawn via the wrist pin eye due to the lower wall thickness.

To further reduce the wall thickness between the piston head and the wrist pin eye, a cavity can be disposed in the piston skirt between the wrist pin eye and the piston head. The depth of the cavity is preferably at least 20%, and in particular more than 30%, of the radius of the piston. The cavity effects a reduction of the wall thickness above the wrist pin eye, and hence a reduction of the introduction of heat into the wrist pin eye. At the same time, a reduction in weight is achieved by the cavity. The cavity is connected with the bore in the wrist pin eye by an opening. As a result, the cavity can be disposed close to the wrist pin eye. The cavity can be large, thus resulting in a reduction of the weight of the piston. Even with a piston having a low overall size and a small distance between the piston head and the wrist pin eye, a cavity that is connected with the wrist pin eye by an opening can still be provided. The cavity preferably extends in the direction toward the undercut and thus reduces the wall thickness between the cavity and the undercut. The wall thickness in this region is preferably less than 35%, in particular less than 30%, of the radius of the piston.

The piston can have at least one piston pocket for a fluidic connection of an air channel with a transfer window of the two-cycle engine. The piston pocket is expediently disposed next to a wrist pin eye. However, the wrist pin eye can also be disposed in the piston pocket.

Further specific features of the present invention will be described in detail subsequently.

Description of Specific Embodiments

Figure 2:
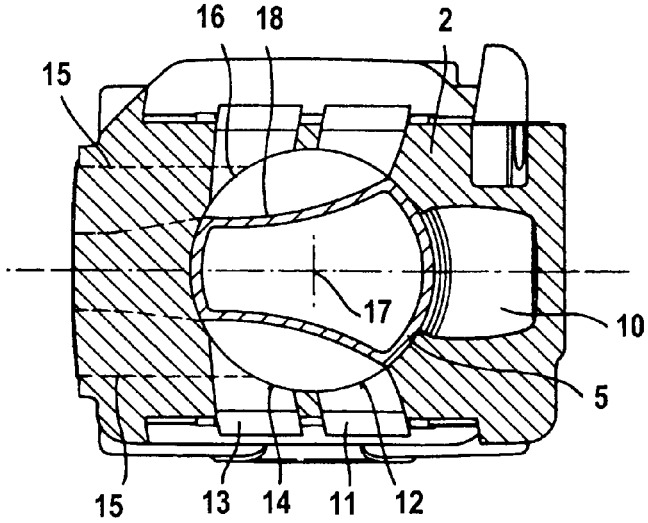
FIG. 2 is a cross-sectional view taken along the line II-II in FIG. 1.
Figure 3:
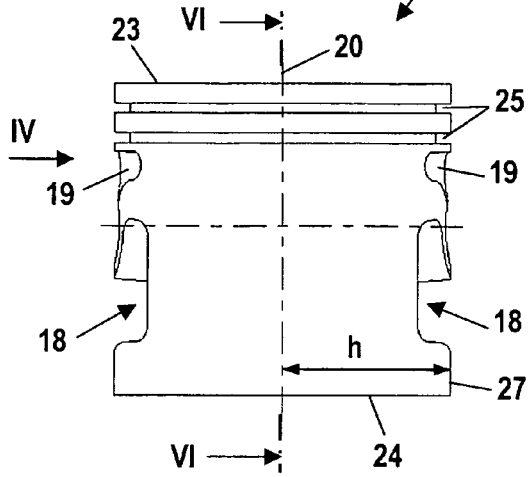
FIG. 3 is a side view of a piston.

The mixture-lubricated two-cycle engine 1 shown in FIG. 1 is intended for a manually-guided implement, such as a power saw, a cut-off machine, or the like. The two-cycle engine 1 has a cylinder 2 in which is formed a combustion chamber 3, which is delimited by a piston 5 that is mounted so as to reciprocate in the cylinder 2. By means of a connecting rod 6, the piston 5 drives a crankshaft 7 that is rotatably mounted in a crankcase 4. The connecting rod 6 is secured to the piston 5 by a wrist pin 38. The two-cycle engine 1 has a mixture inlet 9 that opens out at the cylinder bore 39. The mixture inlet 9 is port-controlled by the piston 5. In the region of the upper dead center position of the piston 5, the mixture inlet 9 is opened into the crankcase 4, so that fuel/air mixture can be drawn into the crankcase. A spark plug 8 extends into the combustion chamber 3 for ignition of the fuel/air mixture. Leading out of the combustion chamber 3 is an outlet 10. In the region of the lower dead center position of the piston 5 shown in FIG. 1, the combustion chamber 3 is connected with the crankcase 4 via two transfer channels 11 and two transfer channels 13. The transfer channels 11, 13 are disposed symmetrically relative to one another (FIG. 2). The transfer channels 11, which are closer to the outlet 10, open via transfer windows 12 into the combustion chamber 3, while the transfer channels 13, which are remote from the outlet 10, open into the combustion chamber via transfer windows 14. As also shown in FIG. 2, two branches of an air channel 15 open via air channel windows 16 at the cylinder bore 39. The air channel windows 16 are disposed below the transfer windows 14 of the transfer channels 13 that are remote from the outlet 10. The piston 5 is provided with two piston pockets 18, each of which is disposed in the region of two transfer channels 11 and 13. In the region of the upper dead center position of the piston 5, the air channel 15 is connected with the transfer channels 11 and 13 by the piston pockets 18.

During operation of the two-cycle engine 1 and during the movement of the piston 5 out of the position shown in FIG. 1 in the direction of the longitudinal cylinder axis 17 to the combustion chamber 3, fuel/air mixture is drawn into the crankcase 4 through the mixture inlet 9. In the region of the upper dead center position of the piston 5, substantially fuel-free air from the air channel 15 is temporarily stored in the transfer channels 11 and 13 and flows from the combustion chamber end of the transfer channels 11 and 13 in the direction toward the crankcase 4. During the downward stroke of the piston 5, the fuel/air mixture is compressed in the crankcase 4. In the region of the lower dead center position of the piston 5, the piston opens the transfer windows 12 and 14, so that first the substantially fuel-free air previously collected in the transfer channels 11 and 13, and subsequently fuel/mixture from the crankcase 4, can flow into the combustion chamber 3. During the upward stroke of the piston 5, the mixture is compressed in the combustion chamber 3 and is ignited by the spark plug 8 in the region of the upper dead center position of the piston 5. Due to the combustion, the piston 5 is accelerated toward the crankcase 4. As soon as the outlet 10 is opened by the piston 5, the exhaust gases flow out of the combustion chamber 3. The exhaust gases are scavenged out of the combustion chamber 3 through the outlet 10 by the substantially fuel-free air that flows into the combustion chamber 3 from the transfer channels 11 and 13.

The piston 5 is illustrated to an enlarged scale in FIGS. 3 to 7. The piston 5 has a longitudinal axis 20 that during the operation of the two-cycle engine 1 coincides with the longitudinal axis 17 of the cylinder. The piston 5 has a piston head 23 that is flat and delimits the combustion chamber 3. The lower edge 24 of the piston 5, which faces the crankcase 4, is also flat. Below the piston head 23, in the piston skirt 27, the piston 5 is provided with two circumferential grooves 25 in which are disposed piston rings that seal the combustion chamber 3 relative to the crankcase 4.

Figure 4:
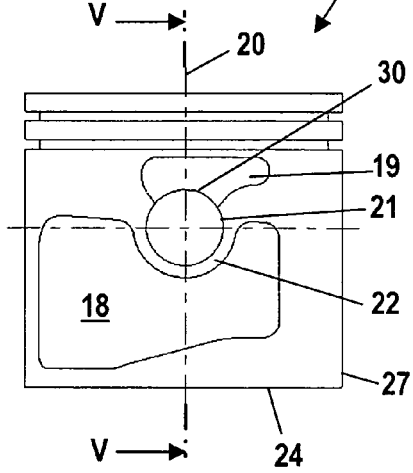
FIG. 4 is a side view of the piston of FIG. 3 taken in the direction of the arrow IV in FIG. 3.
Figure 5:
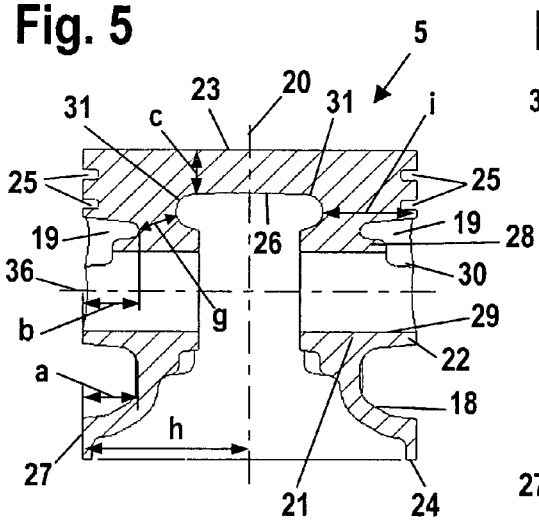
FIG. 5 is a cross-sectional view taken along the line V-V in FIG. 4.

As shown in FIGS. 4 and 5, the piston 5 has two wrist pin eyes 21 in which the piston or wrist pin 38 is disposed in a bore 29 thereof. The wrist pin 38 extends in the direction of the longitudinal axis 36 of the wrist pin, which is perpendicular to the longitudinal axis 20 of the piston. Disposed between each wrist pin eye 21 and the piston head 23 is a cavity 19 that extends from the piston skirt 27 into the piston 5. However, the cavities 19 do not communicate with the interior of the piston. The cavities 19 are disposed directly above the wrist pin eyes 21 and are connected with the bores 29 for the wrist pin 38 via a respective opening 30. The opening 30 does not extend over the entire depth b of the cavities 19, as measured radially relative to the longitudinal axis 20 of the piston, but rather over approximately half of the depth b. In the region of the cavity 19 facing away from the grooves 25, a strip 28 is disposed between the cavity 19 and the bore 29. Provided in the region of the opening 30 is a recess for a retaining ring that secures the position of the wrist pin 38 in the bore 29.

The piston 5 has two piston pockets 18 that are disposed across from one another and are disposed between the lower edge 24 of the piston 5 and the wrist pin eyes 21 as well as adjacent to the wrist pin eyes. The piston pocket 18 is separated from the wrist pin eye 21 by a strip 22 (FIGS. 4 and 5).

As shown in FIG. 5, disposed between each wrist pin eye 21 and the piston head 23 is an undercut or relief groove 31, which extends outwardly from the interior of the piston. The undercut 31 can be produced during the manufacture of the piston 5 in a casting processing using collapsible cores. The piston 5 is monolithically formed. In the region of the undercut groove 31, the piston 5 has a wall thickness i. The depth of the undercut 31 is such that the wall thickness i is less than half of the radius h of the piston 5. The cavity 19 is disposed approximately at the level of the undercut 31, and in particular is offset relative to the undercut 31 slightly in the direction toward the lower edge 24 of the piston 5. The thickness g between the cavity 19 and the undercut 31 is less than 35%, and in particular less than 30%, of the radius h of the piston 5. The depth a of the piston pocket 18, measured radially relative to the longitudinal axis 20 of the piston, preferably corresponds approximately to the depth b of the cavity 19. The undercut 31 is spaced from the piston head 23 in the direction of the longitudinal axis 20 of the piston by a distance c.

Figure 6:
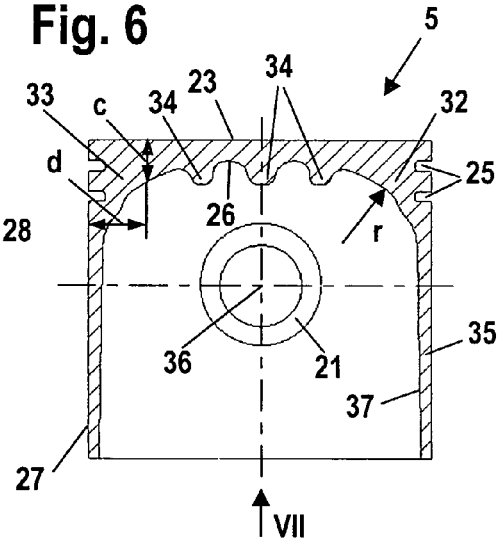
FIG. 6 is a cross-sectional view taken along the line VI-VI in FIG. 3.

As shown in the cross-sectional view of FIG. 6, the piston 5, in those regions that are rotationally shifted about the longitudinal axis 20 of the piston by 90° relative to the wrist pin eyes 21, is provided with thickened portions 32 and 33. In this connection, the thickened portion 32 is disposed at that region of the piston 5 that faces the outlet 10, and the thickened portion 33 is disposed at that region that faces the mixture inlet 9. The thickness d of the thickened portions 32 and 33, measured radially relative to the longitudinal axis 20 of the piston and at a distance c from the piston head 23 that corresponds to the distance c of the undercut 31 from the piston head 23, is at least 20%, and preferably more than 30%, of the radius h of the piston 5. At the thickened portions 32 and 33, the inner wall 37 of the piston 5 merges, with a radius r, from the piston skirt 27 into the underside 26 of the piston head 23. The radius r is at least 30% of the radius h of the piston 5. Due to the relatively large radius r, the thickened portions 32 and 33 are formed and there results a uniform progress of the thickness of the piston 5. To reduce weight, the thickness of the piston wall 35 is considerably less than the wall thickness d in the region of the thickened portions 32 and 33.

Figure 7:
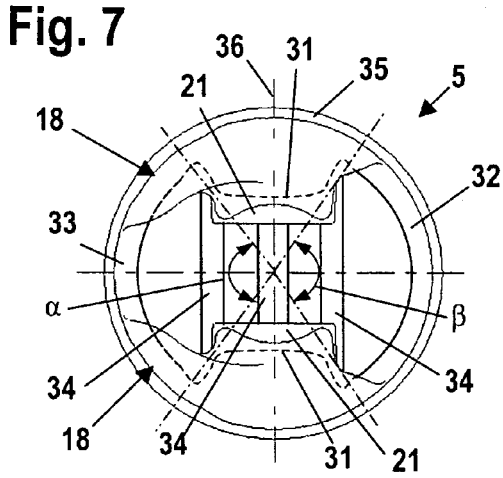
FIG. 7 is a view of the piston of FIG. 6 in the direction of the arrow VII in FIG. 6.

As also shown in FIG. 7, ribs 34 are disposed on the underside 26 of the piston head 23. The underside 26 of the piston head 23 is open toward the crankcase 4, so that the underside 26 delimits the crankcase 4. Three ribs 34 are provided on the underside 26 that extend parallel to the longitudinal axis 36 of the wrist pin 38 between the two undercuts 31. The ribs 34 lead to an increase of the surface of the underside 26 of the piston head 23, thus facilitating heat transfer from the piston head 23. At the same time, the ribs 34 result in a reinforcement of the piston 5 with little additional weight.

As shown in FIG. 7, the thickened portions 32 and 33 extend over the entire periphery of the piston 5 between the undercuts 31. The undercuts 31 are shown by dashed lines in FIG. 7, and in the view onto the piston 5 from below in FIG. 7, the undercuts are covered by the two piston pockets 18 and the wrist pin eyes 21. The thickened portion 32 at the outlet side extends over an angle β, and the thickened portion 33 at the inlet side extends over an angle α. The angles α and β can be approximately the same, and are advantageously between 80° and 150°. The thickened portions 32 and 33 effect a good transfer of heat from the piston head 23 into the piston wall 35 at those sections disposed at the inlet and outlet sides. Due to the presence of the undercuts 31, the transfer of heat into the wrist pin eyes 21 is reduced.

Figure 8:
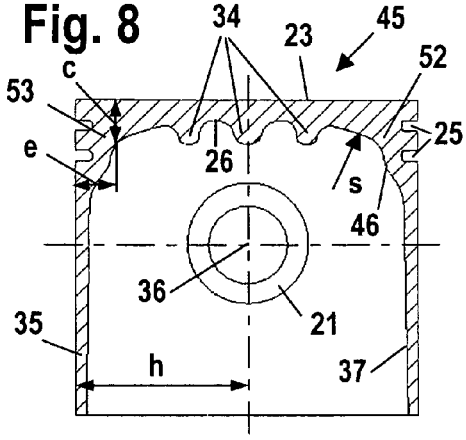
FIGS. 8 & 9 are cross-sectional views of pistons in a view similar to the illustration in FIG. 6.

An embodiment of a piston 45 is shown in FIG. 8. The piston 45 corresponds essentially to the piston 5, so that the same elements are designated by the same reference numerals. The piston 45 has three ribs 34 on the underside 26 of the piston head 23 that extend parallel to the longitudinal axis 36 of the wrist pin eye 21. At the distance c of the undercut 31 from the piston head 23, the piston 45 has a thickened portion 52 on the outlet side and a thickened portion 53 on the inlet side. At the distance c from the piston head 23, the thickened portions 52 and 53 have a wall thickness e that is at least 20% of the radius h of the piston 45. The inner wall 37 of the piston 45 merges, with a radius s, into the underside 26 of the piston head 23. The radius s at the thickened portions 52 and 53 leads to a uniform change of the wall thickness and to a good transfer of heat into the piston wall 35. Below the grooves 25 for the piston rings, a circumferential bead 46 is disposed on the thickened portions 52 and 53 that ensures an adequate wall strength for the piston rings in the region of the grooves 25.

Figure 9:
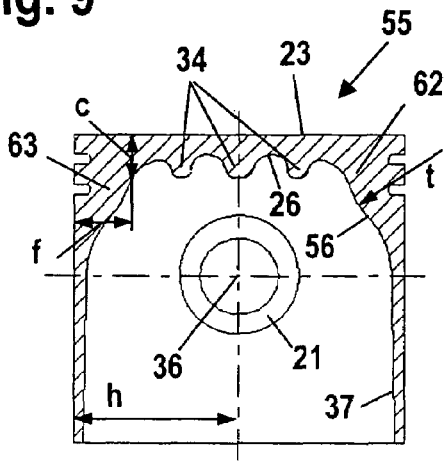
Figure 10:
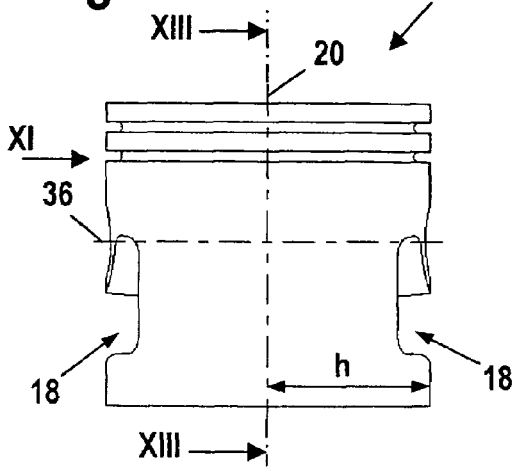
FIG. 10 is a side view of a piston.
Figure 11:
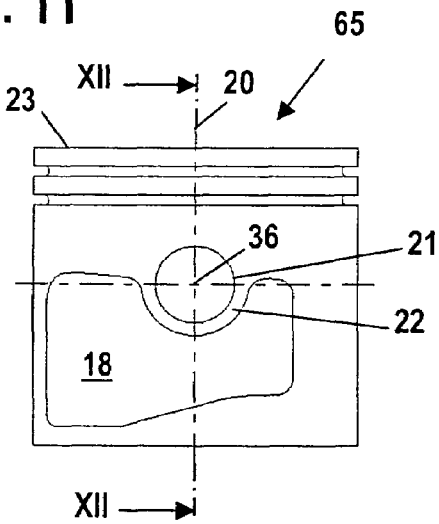
FIG. 11 is a side view of the piston of FIG. 10 in a direction of the arrow XI in FIG. 10.

With the embodiment of a piston 55 shown in FIG. 9, the inner wall 37, with a radius t, merges into the underside 26 of the piston head 23. The radius t is curved inwardly, so that the thickened portions 62 and 63 are formed as the bead 56. At the distance c from the piston head 23, the thickened portions 62 and 63 have a wall thickness f that is more than 30% of the radius h of the piston 55. Three ribs 34 that are disposed parallel to the longitudinal axis 36 of the wrist pin eye 21 are provided on the underside 26 of the piston head 23.

Figure 12:
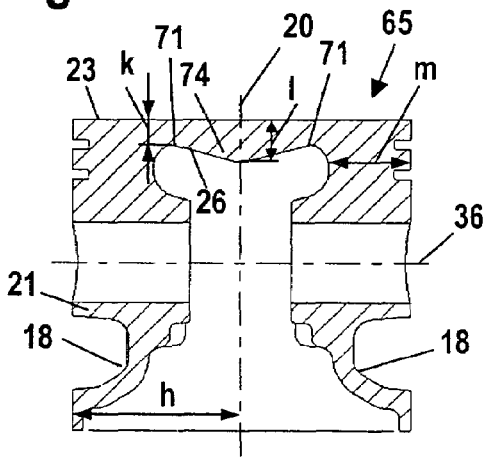
FIG. 12 is a cross-sectional view taken along the line XII-XII in FIG. 11.
Figure 13:
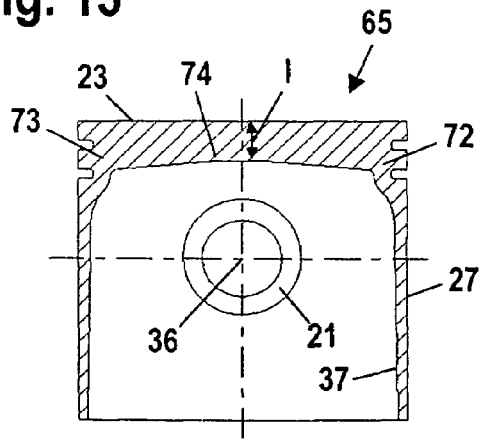
FIG. 13 is a cross-sectional view taken along the line XIII-XIII in FIG. 10.

A further embodiment of a piston 65 is shown in FIGS. 10 to 13. The piston 65 has wrist pin eyes 21 as well as piston pockets 18 disposed therebelow. However, no further cavity for saving weight is provided between the wrist pin eyes 21 and the piston head 23. Instead, the piston 65 has the undercuts 71 that are shown in FIG. 12 and that extend outwardly from the interior of the piston between the wrist pin eyes 21 and the piston head 23. In the region of the undercut 71, the wall thickness m of the piston 65 is less than half of the radius h of the piston 65. The undercut 71 is spaced from the piston head 23 by the distance k. A rib 74 is disposed on the underside 26 of the piston head 23 and extends perpendicular to the longitudinal axis 36 of the wrist pin eye 21 and also perpendicular to the longitudinal axis 20 of the piston 65. The height l of the rib 74, measured from the piston head 23, is greater than the distance k of the undercut 71 from the piston head 23. As shown in the cross-sectional view of FIG. 13, on the underside 26 of the piston head 23 the ends of the ribs 74 merge into a thickened portion 73 at the inlet side and a thickened portion 72 at the outlet side. This ensures that heat from the piston head 23 is essentially introduced into those regions of the piston skirt 27 disposed between the wrist pin eyes 21.

Figure 14:
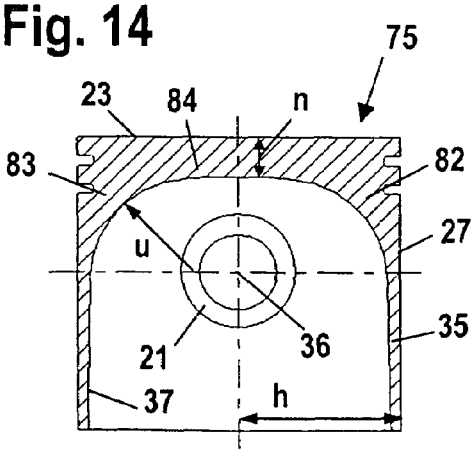
FIG. 14 is a cross-sectional view of a piston similar to the illustration in FIG. 13.

The piston 75 shown in FIG. 14 corresponds essentially to the piston 65 of FIGS. 10 to 13. The piston 75 has a rib 84 that extends perpendicular to the longitudinal axis 36 of the wrist pin eye 21. The rib 84 has a height n that is greater than the distance k of the undercut 71 from the piston head 23. The ends of the rib 84 merge, with a radius u, into the inner wall 37 of the piston 75. The radius u is greater than 30% of the radius h of the piston 75. In the illustrated embodiment, the radius u is approximately half of the radius h. At the transition of the rib 84 into the piston wall 35, the radius u thus forms a thickened portion 82 at the outlet side and a thickened portion 83 at the inlet side. The thickened portions 82 and 83 preferably also each extend on both sides of the rib 84 to the undercuts 71. The wrist pin eye 21 can also be disposed in a piston pocket 18.

The specification incorporates by reference the disclosure of German priority document DE10 2005 003 061.0 of 22 Jan. 2005.

The present invention is, of course, in no way restricted to the specific disclosure of the specification and drawings, but also encompasses any modifications within the scope of the appended claims.

We claim:

1. A piston for a two-cycle engine, comprising:

a piston head that is adapted to delimit a combustion chamber of the engine, wherein an underside of said piston head is adapted to delimit a crankcase of the engine;

a piston wall in which are disposed wrist pin eyes that are adapted to support a wrist pin, wherein at least one undercut is formed between said underside of said piston head and said wrist pin eyes at a distance from said piston head, and wherein said at least one undercut extends from an interior of said piston in a direction toward said piston wall; and a respective thickened portion in at least one region of said piston that is rotationally shifted about a longitudinal axis of said piston by 90° relative to one of said wrist pin eyes, wherein said thickened portion is disposed at a distance below said piston head and extends into said interior of said piston, and wherein a wall thickness of said piston at said thickened portion, at said distance of said at least one undercut from said piston head below said piston head, is at least 20% of a radius of said piston.

2. A piston according to claim 1, wherein two oppositely disposed undercuts are provided, and wherein said thickened portion extends in a circumferential direction from one undercut to an opposite undercut.

3. A piston according to claim 1, wherein two oppositely disposed thickened portions are provided.

4. A piston according to claim 1, wherein said wall thickness of said piston at said thickened portion, at said distance of said at least one undercut from said piston head below said piston head, is greater than 30% of said radius of said piston.

5. A piston according to claim 1, wherein a wall thickness of said piston in the region of said at least one undercut is less than half of a radius of said piston.

6. A piston according to claim 1, wherein at least one rib is disposed on said underside of said piston head, and wherein said rib extends approximately parallel to a longitudinal axis of said wrist pin eyes.

7. A piston according to claim 1, wherein a cavity is disposed in said piston wall between said wrist pin eyes and said piston head.

8. A piston according to claim 7, wherein a depth of said cavity is at least 20% of a radius of said piston.

9. A piston according to claim 8, wherein the depth of the cavity is greater than 30% of the radius of the piston.

10. A piston according to claim 7, wherein a wall thickness of said piston between said cavity and said at least one undercut is less than 35% of a radius of said piston.

11. A piston according to claim 10, wherein the wall thickness of the piston between said cavity and said at least one undercut is less than 30% of the radius of said piston.

12. A piston according to claim 1, wherein said piston has at least one piston pocket for a fluidic connection of an air channel with a transfer window of said two-cycle engine.

13. A piston according to claim 12, wherein said piston pocket is disposed adjacent to a wrist pin eye.

14. A piston according to claim 1, wherein said distance of said at least one undercut from said piston head is the same as said distance of said thickened portion below said piston head.

15. A piston for a two-cycle engine, comprising:

a piston head that is adapted to delimit a combustion chamber of the engine, wherein an underside of said piston head is adapted to delimit a crankcase of the engine;

a piston wall in which are disposed wrist pin eyes that are adapted to support a wrist pin, wherein at least one undercut is formed between said underside of said piston head and said wrist pin eyes at a distance from said piston head, and wherein said at least one undercut extends from an interior of said piston in a direction toward said piston wall; and a respective thickened portion in at least one region of said piston that is rotationally shifted about a longitudinal axis of said piston by 90° relative to one of said wrist pin eyes, wherein said thickened portion is disposed at a distance below said piston head and extends into said interior of said piston, and wherein an inner wall of said piston extends from said piston wall to said underside of said piston head with a radius that is at least 30% of a radius of said piston.

16. A piston for a two-cycle engine, comprising:

a piston head that is adapted to delimit a combustion chamber of the engine, wherein an underside of said piston head is adapted to delimit a crankcase of the engine;

a piston wall in which are disposed wrist pin eyes that are adapted to support a wrist pin, wherein at least one undercut is formed between said underside of said piston head and said wrist pin eyes at a distance from said piston head, and wherein said at least one undercut extends from an interior of said piston in a direction toward said piston wall; and a respective thickened portion in at least one region of said piston that is rotationally shifted about a longitudinal axis of said piston by 90° relative to one of said wrist pin eyes, wherein said thickened portion is disposed at a distance below said piston head and extends into said interior of said piston, wherein at least one rib is disposed on said underside of said piston head, and wherein said rib extends transverse to a longitudinal axis of said wrist pin eyes, and wherein at least a section of a thickened portion is formed by a rib.

17. A piston according to claim 16 wherein a height of said at least one rib, as measured from said piston head, is greater than said distance of said at least one undercut from said piston head.

* * * * *